US010403098B2

(12) United States Patent
Stone

(10) Patent No.: US 10,403,098 B2
(45) **Date of Patent: *Sep. 3, 2019**

(54) SLOT MACHINE

(71) Applicant: Allen Stone, Wakefield, MA (US)

(72) Inventor: Allen Stone, Wakefield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/002,312

(22) Filed: Jun. 7, 2018

(65) Prior Publication Data

US 2018/0286184 A1 Oct. 4, 2018

Related U.S. Application Data

(63) Continuation-in-part of application No. 15/690,356, filed on Aug. 30, 2017, now Pat. No. 9,997,019, which is a continuation-in-part of application No. 14/686,968, filed on Apr. 15, 2015, now Pat. No. 9,773,374.

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01); *G07F 17/3227* (2013.01)

(58) Field of Classification Search
USPC ..... 463/20
See application file for complete search history.

(56) References Cited

U.S. PATENT DOCUMENTS

| | | | | |
|---|---|---|---|---|
| 5,212,636 | A | 5/1993 | Nakazawa | |
| 6,056,642 | A | 5/2000 | Bennett | |
| 6,871,194 | B1 | 3/2005 | Cardno | |
| 7,857,696 | B2 | 12/2010 | Tarantino | |
| 8,376,839 | B2 | 1/2013 | Lesley et al. | |
| 8,532,798 | B2 | 9/2013 | Ferraro, III et al. | |
| 8,713,707 | B2 | 4/2014 | Hamalainen et al. | |
| 9,495,843 | B2 * | 11/2016 | Itagaki | G07F 17/3267 |
| 2009/0186679 | A1 | 7/2009 | Irvine et al. | |
| 2012/0123567 | A1 | 5/2012 | Nayak et al. | |
| 2013/0254146 | A1 | 9/2013 | Ellis et al. | |
| 2014/0342802 | A1 * | 11/2014 | Itagaki | G07F 17/34 463/20 |

(Continued)

FOREIGN PATENT DOCUMENTS

| | | |
|---|---|---|
| EP | 1054368 | 11/2000 |
| WO | 2004104721 | 12/2004 |
| WO | 2006102441 | 9/2006 |

*Primary Examiner* — Pierre E Elisca

(74) *Attorney, Agent, or Firm* — Lambert Shortell & Connaughton; Gary E. Lambert; David J. Connaughton, Jr.

(57) ABSTRACT

A slot machine device providing a unique operation, payout scheme, and structure. This slot machine provides optional, unique game play features. These features may include a Notice feature which informs a player if the next cycle will be a win or a loss; a Flush feature allowing a player to discard a losing cycle; a Do-Over feature, allowing a player to replay a cycle if they do not like the results of the prior cycle; a skill-based feature that requires the player to display an element of skill; and a social feature that requires the player to perform a social task. These features may be turned on and off, and the slot machine may be configured to automatically adjust a payout option depending on what features are activated.

20 Claims, 4 Drawing Sheets

(56) References Cited

U.S. PATENT DOCUMENTS

| | | | | |
|---|---|---|---|---|
| 2015/0213692 | A1* | 7/2015 | Itagaki | G07F 17/34<br>463/20 |
| 2015/0371491 | A1* | 12/2015 | Itagaki | G07F 17/34<br>463/20 |
| 2016/0284167 | A1* | 9/2016 | Mio | G07F 17/3255 |

* cited by examiner

SLOT MACHINE

BACKGROUND OF THE INVENTION

Field of the Invention

The present invention relates generally to slot machine devices. More particularly the present invention relates to a slot machine device providing strategic and advantageous modes of game play.

Description of Related Art

Slot machines are extremely popular with those attending casinos. Slot machines provide enjoyable game play at a pace determined by the player, and can be enjoyed for an extended period of time by the player. Slot machines are highly profitable for casinos and other gambling establishments. As such there is an incentive to keep slot machine game play creative and exciting. Further, it is advantageous to a casino to incentivize faster game play and/or larger bets. This faster game play and larger betting may also be more exciting and enjoyable to a player. Further still, actual and/or perceived advantages provided in game play to a player may further increase both profits to the casino and enjoyment to the player.

Therefore, what is needed is a slot machine device that may provide additional game play modes that provide a strategic element to game play and also an actual and/or perceived advantage to the player.

SUMMARY OF THE INVENTION

The subject matter of this application may involve, in some cases, interrelated products, alternative solutions to a particular problem, and/or a plurality of different uses of a single system or article.

In one aspect, a method for conducting a slot machine game is provided. The method utilizes an electronic slot machine having a data processor in communication with a display, a user interface, and a computer memory. The computer memory is configured to store electronic representations of slot machine reels and the markers thereon for presentation by the display. The display may consist of a window through which physical reels, manipulated by stepper motors, can be viewed, or a video display device on which virtual reels can be simulated. The memory further stores program instructions executable by the data processor to conduct the steps of the method.

The method of slot machine game play begins with the player inputting a quantity of money. The player may then coordinate bets and strategy with the input money. The player then triggers the actuator, typically an arm or button, or other method, which initiates the spinning of the reels. During the spin, or perhaps at another time in another aspect of the invention, the processor determines if the results for this cycle had been predetermined by a previous cycle. If the results for this cycle have been predetermined by a previous cycle, those predetermined results are presented to the player. If the results for this cycle have not been predetermined by a previous cycle, the processor instructs the Random Number Generated to generate new results for this cycle and these new results are presented to the player. Regardless of whether new results are generated for this cycle, or whether results for this cycle had been previously determined, the processor directs the Random Number Generator to create results for the next cycle. The results for the next cycle are stored in memory and will be presented to the player after this cycle completes.

It should be noted that the results for the next cycle, which are stored in memory, may be stored indefinitely or for a shorter period of time. For example, in one implementation, the results for the next cycle may remain in memory indefinitely. In another implementation, the results for the next cycle may be stored for a specified amount of time, perhaps one hour. In yet other implementations, the results may be stored for ten minutes, thirty minutes, two hours, one day, or any other period of time as defined by the programming of the slot machine.

After the results have been generated (for this cycle, if needed and for the next cycle every time), the results for this cycle are presented to the player through the manipulation of the reels, and all winnings for this cycle, if any, are presented to the player.

After the payout for this cycle, if any, is presented to the player, but before the player inputs money for the next cycle, the data processor checks the results for the next cycle that are stored in memory. If the results stored in memory indicate a win, the player receives a visual and/or audio indication that the next cycle will result in a win. If the results stored in memory indicate a loss, no notification is given to the player. In this implementation, the player is only notified if the next cycle will result in a win, and no notification is given in the event that the next cycle will result in a loss. In another implementation, the Notice feature may give a separate, distinct indication that the next cycle will be a loss. With this Notice feature, the player is informed, prior to wagering money for the next cycle, whether or not the next cycle will be a win or a loss.

There are many ways in which the Notice feature can be implemented. In one aspect of the invention, the Notice feature may be a simple flashing of a light. In another aspect of the invention, the Notice feature may take the form of an audio signal such as a bell or whistle. In another aspect of the invention, the Notice feature may take the form of a complicated, animated video clip. And in still another aspect of the invention, the Notice feature may take the form of some other combination of visual and/or audio cues.

In another aspect, a slot machine is provided. The slot machine is an electronic slot machine having a data processor in communication with a display, a user interface, and a computer memory. The computer memory is configured to store electronic representations of slot machine reels and the markers thereon for presentation by the display, and program instructions executable by the data processor to conduct the game play of the machine. In addition to traditional slot machine game play, this slot machine provides optional unique game play features. These features may include: A Notice feature which informs a player if the next cycle will be a win or a loss; a Flush feature allowing a player to discard a losing cycle; and a Do-Over feature, allowing a player to replay an unsatisfactory cycle. These features may be turned on and off by the slot machine player. Further, the data processor of the slot machine may be configured to automatically adjust payout programming such as a payout option and payout percentage depending on what features are activated to ensure a constant or approximately constant payout rate is maintained, regardless of game play features selected.

DETAILED DESCRIPTION

Figure 1:
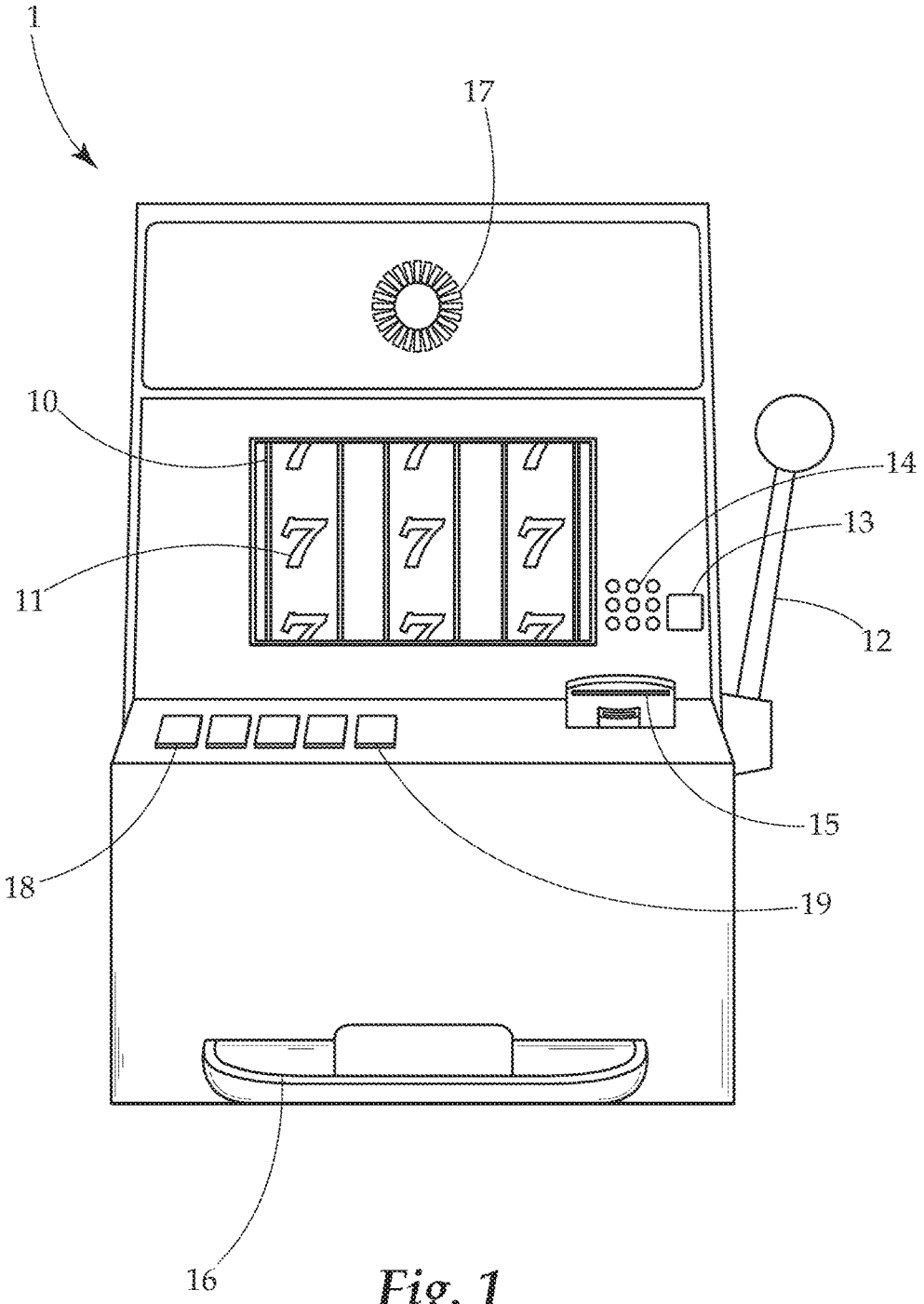
FIG. 1 provides a view of an embodiment of the slot machine of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a slot machine device providing a unique operation, payout programming, and structure. This slot machine provides optional, unique game play features. These features may include: A Notice feature which informs a player if the next cycle will be a win or a loss; a Flush feature allowing a player to discard a losing cycle; and a Do-Over feature, allowing a player to replay a cycle if they do not like the results of the previous cycle; a skill-based feature that requires the player to display an element of skill; a social feature that requires the player to perform a social task; and the like. These features may be turned on and off, and the slot machine may be configured to automatically adjust a payout option depending on what features are activated.

The slot machine is formed generally by a machine body, which provides a housing and structure for the slot machine. On and in this body is an interface, which allows input to the machine and output to a player of the machine. The input includes a money or payment input (generally referred to herein as a money input), which may be a card reader, cash input slot, electronic payment input, or the like. A betting input is also present as part of the interface. The betting input allows a user to select a bet quantity and/or type, such as a minimum bet, maximum bet, or a bet in between. The interface further comprises an actuator that initiates a spinning of the reels of the slot machine. This may be a physical lever or other structure, such as a button that triggers the movement. In fully electronic machines, the actuator may just trigger a spinning of virtual reels on a screen, and in mechanical machines, the actuator physically triggers a spinning of the reel or reels. A display output is provided as part of the interface. This may be a computer display screen, or a window allowing viewing into the spinning reel or reels. Further, within the housing and as part of a control system of the slot machine is a randomizer. The randomizer is configured to provide a random result. This randomizer may be electronic, such as a programmed computerized random number generating module carried out by a data processor, or may be a mechanical structure that controls a spinning of a reel or reels. For the purposes of the present invention, this randomizer (device, function, module-depending on embodiment) may be in the form of a determining module programmable and/or adjustable to control a payout percentage and payout size (payout programming) based on a selected type of game play. The selected game play may be entered into the slot machine through a user interface selecting from one of a plurality of game play types. In other embodiments, control over the payout percentage and payout size may be a function of the programmed logic of the processor. The interface further includes a payout output, which provides a way for a player to receive a payout. This may be through a printed ticket, electronic credit, cash output, and the like.

In electronic versions of the present invention, a computer having a computerized data processor controls the game play of the machine. The randomizer may be a programmed module, such as an instruction set executable by a data processor, stored in a memory. The computer may be further configured to receive inputs from the interface, and provide output through at least a display screen and, optionally, through other outputs such as lights and/or speakers. In one embodiment, the display may be a touch screen, such that it may also receive inputs. Such electronic versions of the present invention may include computerized slot machines, and may also include embodiments such as fully digital implementations such as fully computerized versions playable on a tablet, smartphone, kiosk, desktop or laptop computer, as well as network based embodiments, internet embodiments, or application embodiments.

In further detail, an embodiment of the computer controlling operation of an electronic version of the slot machine contemplated herein may comprise a data processor such as a microchip, microprocessor, and the like. The processor may be in communication with a display, a player interface, as described above, and a memory device. The memory device may contain the randomizer module, as well as electronic representations of the reel and symbols on the reel, for presentation by the display. The memory may further contain program instructions, in addition to the randomizer module's instructions. These instructions are executable by the data processor to conduct the steps of the game play, as will be detailed below.

In addition to the functions and structure described above, the slot machine of the present invention may have a number of game play enhancements.

In one embodiment, the slot machine may comprise a game play option of a Notice feature which informs a player if the next cycle will be a win or a loss. The Notice feature provides an indication, through the display of the interface, if the next cycle will be a win or a loss. The amount of the win is, typically, not presented. This game play option may always be on in one embodiment, or may be activated and/or deactivated by the player, or by the slot machine owner/operator based on certain conditions, in another embodiment. The presentation by the display may be on a computerized display screen, on a light or other visual indicator, or by a speaker or other audio indicator, or a combination thereof.

In one embodiment, the Notice feature may be integral to game play, with no added consideration required. In other embodiments, additional consideration may be required to use the Notice feature, such as an input of additional payment, requiring a specific bet amount, requiring faster game play (as set by a timer programmed into the computer), the feature is only available after a pre-determined amount of game play (such as 30 uninterrupted cycles), and the like.

In another embodiment, the slot machine may comprise a game play option of a Flush feature. This feature may stand on its own, but will more likely be used in conjunction with the Notice feature, in varying embodiments. The Flush feature allows a player to provide an input to the machine instructing it to discard a losing cycle.

In operation, the Flush feature allows a player to provide an input to the slot machine through the interface that, after receiving a feedback from the Notice feature that the next cycle will not be a win, flushes that result from the game.

Upon receiving a Flush feature input, the microprocessor may erase the results stored in the memory. In most embodiments, the Notice feature will be temporarily disabled after the Flush feature is activated, though the Notice feature may be active in some embodiments.

In some embodiments, the Flush feature may be integral to game play, with no added consideration required. In other embodiments, additional consideration may be required to use the Flush feature, such as an input of additional payment, requiring a specific bet amount, requiring faster game play (as set by a timer programmed into the computer), the feature is only available after a pre-determined amount of game play (such as 30 uninterrupted cycles), and the like.

In yet another embodiment, the slot machine may comprise a game play option of a Do-Over feature. This feature may stand on its own, or may be used in conjunction with the Notice feature and/or Flush feature. The Do-Over feature allows a player to replay a cycle if they do not like the results of the previous cycle.

In operation, the Do-Over feature allows a player to provide an input to the slot machine through the interface that, after receiving a feedback after a cycle has completed of a loss or an undesired win, allows a player to replay the cycle without inputting additional money. In most embodiments, the Notice feature will not activate after the Do-Over feature is activated, though it may in some embodiments. Upon receiving a Do-Over feature input, the microprocessor may be configured to rerun the cycle, providing for a new set of results to be generated.

In some embodiments, the Do-Over feature may be integral to game play, with no added consideration required. In other embodiments, additional consideration may be required to use the Do-Over feature, such as an input of additional payment, requiring a specific bet amount, requiring faster game play (as set by a timer programmed into the computer), the feature is only available after a pre-determined amount of game play (such as 30 uninterrupted cycles), and the like.

Using these game play enhancements, the user may continue repeating game play until they decide to stop.

In some embodiments, one or more of the three listed game play options may be activated and deactivated based on an input to the computer. Upon activation or deactivation of any of the game play options, the processor module may make adjustments to account for increases or decreases in player advantages, to provide an even or approximately even payout rate over time. In other words, upon activation of one of the game play enhancements, a player's odds of winning may be increased. Based on this increase in odds, the processor module adjusts win frequency, payout amounts, or both allowing a casino or slot machine owner to achieve a reasonable profit. The microprocessor may be capable of determining through calculation an appropriate payout rate by the randomizer module, or the different game play option payout rates may be pre-set and programmed into the memory. Further, an administration mode of the computer may allow an owner to manually adjust or input a payout rate and payout table, allowing additional customization. As such, upon selection of a game play type, the processor may select a payout programming corresponding to the selected game play.

Other factors may also contribute to the desire and ability to adjust the payout percentage of the slot machines. For example, the hit percentage, payout table, maximum jackpots, secondary jackpots all may be modified, dynamically, either before, during, or after game play, based on any factors. Some exemplary factors include, but are not limited to, the time of day, the day of the week, the occurrence of special holidays or events, the number of players on the casino floor or the subjective will of the casino owner or operator, user preferences, game play mode, difficulty setting, skill-based task (as discussed below), power-ups used (as discussed below), and combinations thereof.

In another embodiment, a secondary, skill-based task may allow a favorable increase in the payout percentage of the payout rate/programming of the slot machine. Such an embodiment allows an element of skill to be added to the slot machine gaming experience. The secondary skill-based task may be any task that can be implemented on the slot machine that requires a level of skill (as in, not entirely up to chance). Upon completion of the task, or a satisfactory result of the task, the payout programming may be favorably increased thereby increasing a likelihood of a profitable game play by the user. Adjustment of the payout programming may be done in any manner suitable to change the payout amount and/or payout percentage.

Skill-based tasks may be performed individually, or as part of a network or social group. Examples of skill-based tasks include, but are not limited to: answering trivia questions, playing a game, solving a puzzle, and the like. In this embodiment, typically the skill-based task may be integrated into the display of the slot machine and be controlled by the computer processor and memory. As such, one or more skill-based tasks may be stored on the memory of the slot machine device that can be implemented by the processor. Degree of difficulty, and thus probability of success, can be adjusted dynamically by adjusting the effectiveness of the computerized game play, difficulty of the skill-based task. This adjustment may be modified based on any factors. As above, some exemplary factors include, but are not limited to, the time of day, the day of the week, the occurrence of special holidays or events, the number of players on the casino floor or the subjective will of the casino owner or operator, user preferences, game play mode, difficulty setting, skill-based task (as discussed below), power-ups used (as discussed below), and combinations thereof.

In further embodiments, a social aspect may be implemented into the slot machine game play. In such an embodiment, the slot machine may have a computerized network connection to connect the memory and processor of the slot machine to the internet and/or other slot machines.

In one embodiment of social slot machine use, a plurality of networked slot machines may engage in a skill-based task. This task may be cooperative or competitive. If cooperative, users of the networked slot machines may utilize their respective user interfaces to complete the cooperative skill-based task. Upon completion, the payout programming may be favorably adjusted for all slot machine users who cooperatively completed the skill-based task. In another embodiment of social slot machine use, a plurality of networked slot machines may engage in a competitive skill based task. In such an embodiment, the users of the networked slot machines may compete in a skill based task, with the winner or winners receiving a favorably adjusted payout programming, additional credits, and other advantages as discussed herein.

In another embodiment of social slot machine use, a user may be prompted, through the display, to make a social media post, tag, hashtag, and the like. The slot machine may be in networked communication with the internet and may verify if a user has made the instructed post. Upon verification, the payout programming may be favorably adjusted. Such an embodiment allows social networked marketing and the like.

One aspect of the invention may also include a non-transitory computer readable medium having instructions allowing and instructing the data processor to carry out the steps required during game play of the slot machine, as described herein. This non-transitory computer readable medium may be stored within the housing of the slot machine, or may be accessible through an electronic communication system such as a network and/or internet connection.

In still further embodiments, the slot machine may be configured to allow user log-in or user tracking to allow for a persistent, or enduring game play. In such an embodiment, some sort of tracking system, such as a card, log-in information, social media/network log-in, and the like, may be used to track a player's data. In such a configuration, a user's game play, status, preferences, stored credits, and the like may be continuous upon logging into a machine. This continuity may be available between machines at a casino, across various machines from a particular manufacturer, across casinos, across game play platforms (such as a computer game or app and corresponding slot machine), and so on. For example, a user may modify their user data and/or earn credits through a computerized user interface outside of the slot machine, such as through a computerized app or website. The user data modifications and credits earned may be applied to game play on the slot machine in the casino.

The persistent play model allows users to save up various credits, statistics, bonus/rewards points, and the like which may be applicable to a particular slot machine game. Such credits may be redeemed in a game play mode to control in-game incentives, power-ups, and progression through the game. Credits may be saved and redeemed for, for example, bonus rounds, odds increase, jackpot increase, payout table adjustment, and the like as discussed in this disclosure.

In another embodiment of persistent game play, a user may play a computer game/app, or computerized task or work (related or unrelated to an entertainment game). During such activity, the user may accumulate credits which may be redeemed within a casino upon login to a persistent play slot machine. As such, persistent play embodiments blend in-casino slot machine experience, with computerized gaming or tasks outside of the casino. Tracking of status may be done, as noted, by a login or other sort of identification tracking, and data may be stored on a computer network-accessible server accessible by the slot machine as well as by another user computer via the network.

Turning now to FIG. 1, an embodiment of the slot machine of the present invention is shown. The slot machine 1 comprises a number of interface elements, as well as buttons or other inputs to activate the Notice feature, Flush feature, and Do-Over feature, all of which are present on the slot machine 1. The slot machine 1 comprises a payment input 15, actuator 12, shown here as a lever (though could be a button or other actuating structure), and a payout slot 16 to receive a payout when ending game play, if any. A display 10 is in communication with various computerized internal components as detailed above. The display provides a visual feedback of cycle results using representations of spinning reels and the indicators 11 thereon. An audio output speaker 14 is positioned facing where a player would sit and can provide audio output to the player. A selection button 13 allows a player to input betting information, strategy, and the like. This button 13 may be a single button or a number of different buttons allowing various inputs into the slot machine 1 for game play. It should be understood that all of the inputs and outputs are in communication with the computerized system as noted above. Namely, the microprocessor, which can receive inputs and provide outputs depending on operation.

Game play enhancements of the present invention are present on the slot machine 1. The Notice feature 17 is, in this embodiment, a flashing light. This light will flash when the next cycle is determined to be a win, and will be deactivated when the next cycle is determined to be a loss. It should be understood though that the Notice feature may be displayed to a player in any number of ways, and is not limited to the flashing light shown. A plurality of buttons such as those of 18 and 19 allow a user to utilize the Flush feature 18, and the Do-Over feature 19. Upon activation of these buttons, the feature will be used, and any additional consideration required will be prompted on the display as programmed by the microprocessor.

Figure 2:
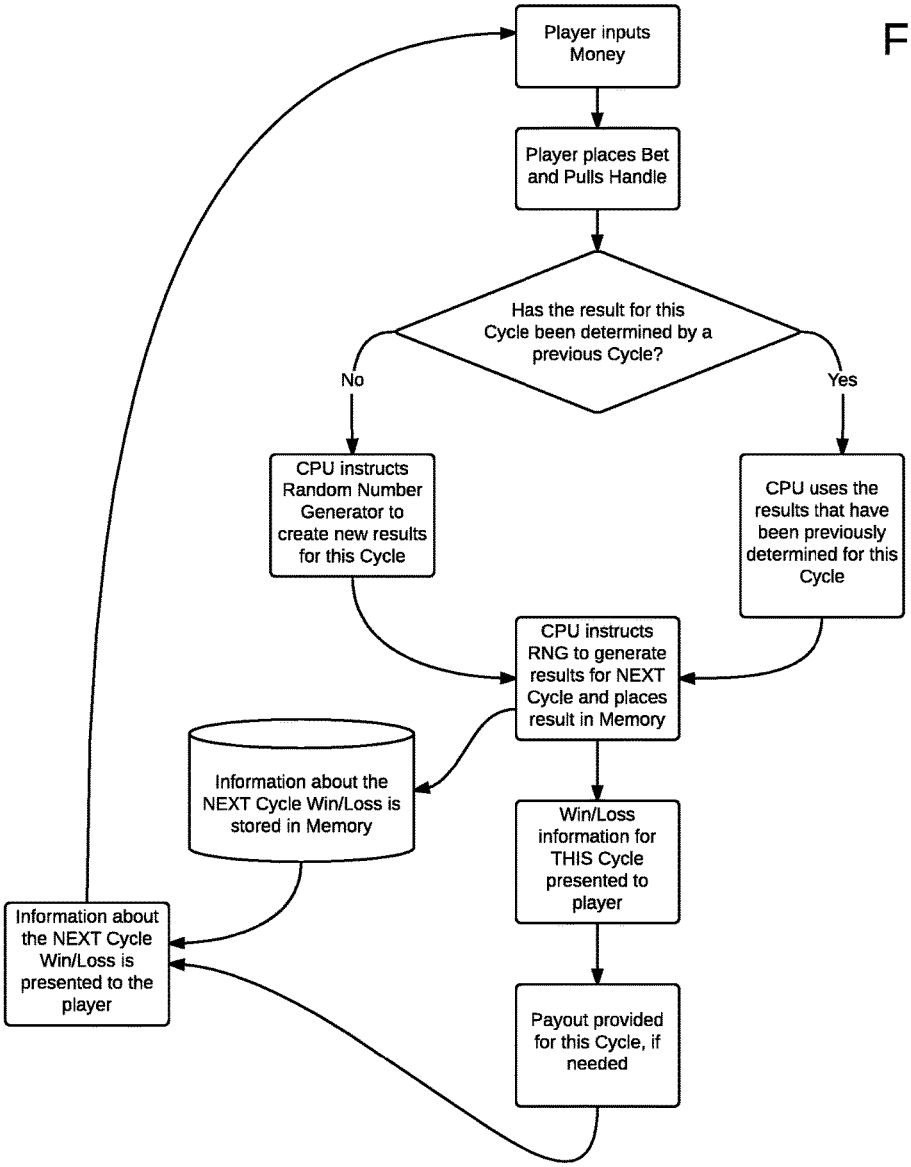
FIG. 2 provides a flow chart of an embodiment of the present invention.

FIG. 2 shows a flow chart of an embodiment of game play on the slot machine having a Notice game play feature. In this view, the game play begins with the player inputting a quantity of money. The player may then coordinate bets and strategy. The player then pulls the handle, or pushes a button, to actuate the spin. At this point, the processor determines whether or not the results for this cycle have been determined by a previous cycle. If the results for this cycle have been determined by a previous cycle, the processor uses those results. If the results for this cycle have not been determined by a previous cycle, the process instructs the randomizer to create results that will be used for this cycle. Regardless of whether the results for this cycle have been predetermined or not, results for the next cycle are also created and placed into memory to be displayed by the Notice feature after this cycle completes.

Now that results for this cycle, as well as results for the next cycle have been determined, the processor instructs the reels to stop at the appropriate positions, thereby informing the player whether this cycle has resulted in a win or a loss. If a win, the appropriate payout is provided.

After the appropriate payout, if any, is presented to the player, but before the player inputs money, or makes betting decisions for the next cycle, the Notice feature retrieves the results for the next cycle from memory and informs the player whether or not the next cycle will result in a win. In this embodiment, the Notice feature informs the player of a win with a flashing light, although many other forms of notification, including video and/or audio cues, are possible.

Figure 3:
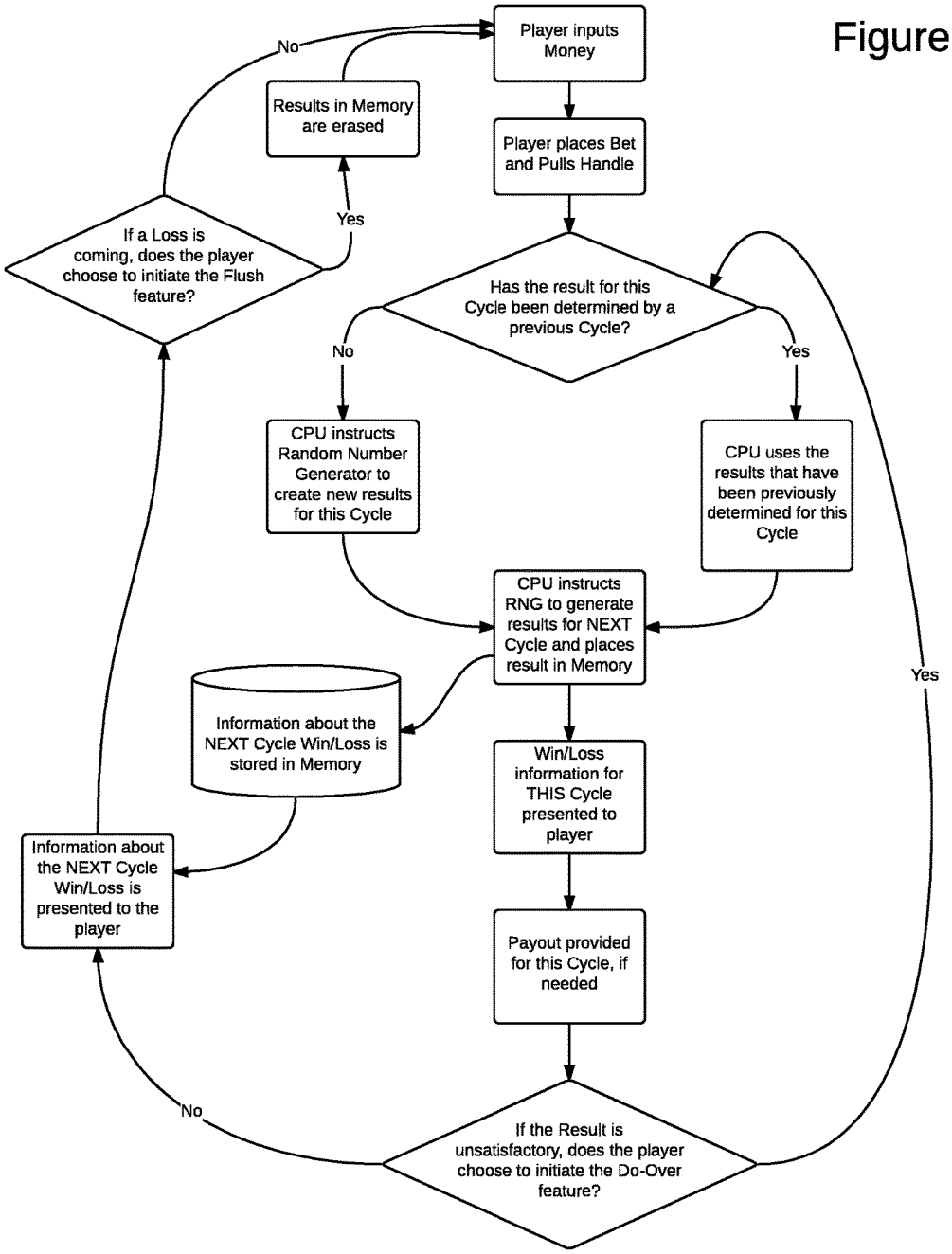
FIG. 3 provides a flow chart of another embodiment of the present invention.

FIG. 3 shows a flow chart of an embodiment of game play on the slot machine having a Notice game play feature, as well as a Flush game play feature and a Do-Over game play feature. In this view, the game play begins with the player inputting a quantity of money. The player may then coordinate bets and strategy. The player then pulls the handle, or pushes a button, to actuate the spin. At this point, the processor determines whether or not the results for this cycle have been determined by a previous cycle. If the results for this cycle have been determined by a previous cycle, the processor uses those results. If the results for this cycle have not been determined by a previous cycle, the processor instructs the randomizer to create results that will be used for this cycle. Regardless of whether the results for this cycle have been predetermined or not, results for the next cycle are also created and placed into memory to be displayed by the Notice feature after this cycle completes.

Now that results for this cycle, as well as results for the next cycle have been determined, the processor instructs the reels to stop at the appropriate positions, thereby informing the player whether this cycle has resulted in a win or a loss. If a win, the appropriate payout is provided.

After the appropriate payout, if any, the player has the opportunity to use the Do-Over feature. If the result of that cycle was unsatisfactory, for example, if a wager of $3 was made and the result was a win of $1, the net affect being a loss of $2, the player may choose to use the Do-Over feature. The player may press a button to activate the Do-Over feature. The slot machine will recognize that the Do-Over feature has been activated and respond by removing any winnings from the cycle, in this case the $1, and activate the reels with the original $3 wager. An additional $3 wager is not taken from the player. The original $3 wager is played again.

In the case where the Do-Over feature was not activated, the player is instead presented with information about the next cycle's win or loss by the Notice feature. In the case that the Notice feature indicates that the next cycle will not be a win, the player may choose to activate the Flush feature. If the player chooses to activate the Flush feature, and presses the appropriate button to do so, the processor will recognize that the Flush feature has been activated and flush the next cycle's results from memory. Therefore, when the next cycle is run, there will be no results predetermined and the machine will generate new results for that cycle.

Figure 4:
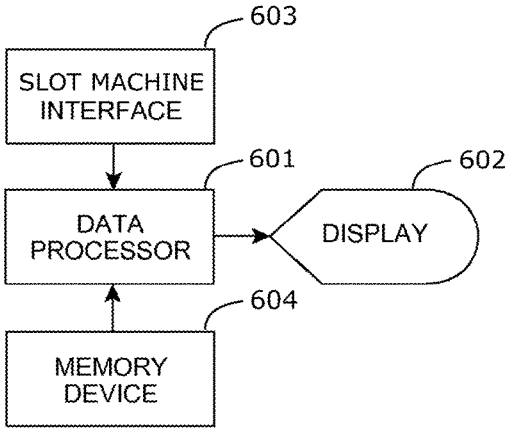
FIG. 4 provides a simplified schematic view of an embodiment of the computerized communication of the slot machine.

FIG. 4 provides a simplified schematic view of an embodiment of the computerized communication of the slot machine. The slot machine interface 603 has elements as described above. These elements communicate with data processor 601. The data processor 601 is further in communication with a memory device 604 which stores instructions for the data processor 601, as well as calculations and determinations by the data processor 601. A display 602 provides a visual output of the results, and any other information that the data processor 601 is instructed to output.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A slot machine for conducting a slot machine game comprising:

a data processor;

a display in communication with the data processor;

a user interface in communication with the data processor; and a computer memory;

the data processor operable to conduct steps of:

receiving an input from a player regarding a bet through the user interface;

receiving a game play input from the player through the user interface;

determining a cycle result, the determining step identifying two elements of information: if the cycle result will be a win; and if the cycle result will be a win, how much a payout will be;

receiving an actuation through the user interface to initiate the cycle;

presenting the determined payout if the cycle was determined a win and presenting that there is no payout if the cycle was determined a loss, after the step of receiving the actuation.

2. The slot machine of claim 1 wherein data processor is further operable to conduct the steps of:

presenting if a next cycle will be a win to the player before the player activates the next cycle through one of the display and the user interface; and after the step of presenting the determined payout or no payout, displaying the next cycle win/loss information and allowing the player, through the user interface, to select at least one of a new play, or to end play.

3. The slot machine of claim 2 wherein the data processor is further operable to conduct the steps of:

receiving at least one of a Flush request and a Do-Over request by the user interface;

wherein the receiving of a Flush request by the player through the user interface after the step of presenting the information element of if the next cycle will be a win to the player before the player activates the next cycle, wherein the Flush request instructs the data processor to erase the determined win/loss information and determined payout, and to repeat the determining the cycle result to generate a second set of elements of information:

if the next cycle will be a win; and if the next cycle will be a win, how much a payout will be; and wherein the receiving of a Do-Over request by the player through the user interface after the step of presenting the determined payout if the cycle was determined a win, and presenting that there is no payout if the cycle was determined a loss, wherein the Do-Over request instructs the data processor to erase the determined win/loss information and determined payout, to reclaim the determined payout, and to replay the bet.

4. The slot machine of claim 1 wherein the data processor is further operable to conduct the steps of:

after the step of receiving the game play input and before the determining step, presenting a skill-based task on the display of the slot machine, the skill-based task completable through the user interface; and upon completion of the skill-based task, adjusting a payout programming.

5. The slot machine of claim 1 wherein the cycle result is based on an adjustable payout programming, and wherein the processor is capable of re-setting the payout programming after the receipt of the actuation and before a next cycle is actuated.

6. The slot machine of claim 5 wherein the re-set of the payout programming is based on one or more of: a time of day, a day of the week, an occurrence of special holidays or events, a number of players on a casino floor, casino owner or operator choice, user choice, game play mode, difficulty setting, skill-based task, and upon user interface input to select a power-up.

7. The slot machine of claim 5 further comprising a networked connection providing a networked communication to the processor and the memory, the networked communication allowing the player to access a server storing a quantity of user information, and wherein the payout programming is based at least in part on the quantity of user information.

8. The slot machine of claim 7 wherein the user information comprises at least one of: user game play history, user status, user preferences, and stored user credits.

9. The slot machine of claim 7 wherein the data processor is operable to adjust a display on the user interface based on the quantity of user information.

10. The slot machine of claim 1 wherein a payout programming is selected to be one of a plurality of preprogrammed data sets stored in the memory based on an input regarding game play type of the player by the user interface.

11. A slot machine for conducting a slot machine game comprising:

a data processor;

a display in communication with the data processor;

a user interface in communication with the data processor; and a computer memory;

the data processor operable to conduct steps of:

receiving an input from a player regarding a bet through the user interface;

receiving a game play input from the player through the user interface the game play input selecting one of a plurality of game play types available on the slot machine;

setting a payout programming based on the game play input;

determining a cycle result, the determining step identifying two elements of information: if the cycle result will be a win; and if the cycle result will be a win, how much a payout will be;

receiving an actuation through the user interface;

presenting the determined payout if the cycle was determined a win and presenting that there is no payout if the cycle was determined a loss, after the step of receiving the actuation; and wherein the processor is capable of re-setting the payout programming after the receipt of the actuation and before a next cycle is actuated.

12. The slot machine of claim 11 wherein the data processor is further operable to conduct the steps of:

after the step of receiving the game play input and before the determining step, presenting a skill-based task on the display of the slot machine, the skill-based task completable through the user interface; and upon completion of the skill-based task, adjusting a payout programming.

13. The slot machine of claim 11 wherein the re-set of the payout programming is based on one or more of: a time of day, a day of the week, an occurrence of special holidays or events, a number of players on a casino floor, casino owner or operator choice, user choice, game play mode, difficulty setting, skill-based task, and upon user interface input to select a power-up.

14. The slot machine of claim 11 further comprising a networked connection providing a networked communication to the processor and the memory, the networked communication allowing the player to access a server storing a quantity of user information, and wherein the payout programming is based at least in part on the quantity of user information, wherein the user information comprises at least one of: user game play history, user status, user preferences, and stored user credits.

15. The slot machine of claim 14 further comprising a networked connection providing a networked communication to the processor and the memory; and wherein the slot machine is in networked communication with a plurality of other slot machines, and wherein the processor is operable to conduct the steps of:

after the step of receiving the game play input and before the determining step, presenting a skill-based task on the display of the slot machine, the skill-based task completable through the user interface and at least partially based on networked communication received by the plurality of other slot machines.

16. The slot machine of claim 15 wherein the processor is operable to store a data relating to completion of the completable task in the quantity of user data.

17. The slot machine of claim 16 wherein the payout programming is re-set based on the user data relating to completion of the completable task.

18. The slot machine of claim 14 wherein the data processor is operable to adjust a display on the user interface based on the quantity of user information.

19. The slot machine of claim 11 wherein data processor is further operable to conduct the steps of:

presenting if a next cycle will be a win to the player before the user activates the next cycle through one of the display and the user interface; and after the step of presenting the determined payout or no payout, displaying the next cycle win/loss information and allowing the player, through the user interface, to select at least one of a new play, or to end play.

20. The slot machine of claim 19 wherein the data processor is further operable to conduct the steps of:

receiving at least one of a Flush request and a Do-Over request by the user interface;

wherein the receiving of a Flush request by the player through the user interface after the step of presenting the information element of if the next cycle will be a win to the player before the player activates the next cycle, wherein the Flush request instructs the data processor to erase the determined win/loss information and determined payout, and to repeat the determining the cycle result to generate a second set of elements of information:

if the next cycle will be a win; and if the next cycle will be a win, how much a payout will be; and wherein the receiving of a Do-Over request by the player through the user interface after the step of presenting the determined payout if the cycle was determined a win, and presenting that there is no payout if the cycle was determined a loss, wherein the Do-Over request instructs the data processor to erase the determined win/loss information and determined payout, to reclaim the determined payout, and to replay the bet.

* * * * *